US007827923B2

(12) United States Patent
Koike et al.

(10) Patent No.: US 7,827,923 B2
(45) Date of Patent: Nov. 9, 2010

(54) SEWING MACHINE HAVING AUTOMATIC THREAD CUTTING DEVICE

(75) Inventors: Mikio Koike, Tokyo (JP); Koji Okutani, Tokyo (JP); Eiji Kanno, Tokyo (JP); Hideaki Kambara, Tokyo (JP); Masashi Ninomiya, Tokyo (JP); Eiichi Shomura, Tokyo (JP); Satoshi Maruo, Tokyo (JP); Mitsuru Nishijima, Tokyo (JP); Michio Hisatake, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 966 days.

(21) Appl. No.: 11/494,381

(22) Filed: Jul. 27, 2006

(65) Prior Publication Data

US 2007/0039530 A1 Feb. 22, 2007

(30) Foreign Application Priority Data

Aug. 22, 2005 (JP) ..... 2005-240483

(51) Int. Cl.
*D05B 65/00* (2006.01)

(52) U.S. Cl. ..... 112/300; 112/285; 112/291; 700/136

(58) Field of Classification Search ..... 112/285, 112/289, 291, 293, 294, 296, 297, 300, 470.05; 700/136–138
See application file for complete search history.

(56) References Cited

U.S. PATENT DOCUMENTS 5,803,001 A * 9/1998 Shimizu et al. ..... 112/291
5,967,069 A * 10/1999 Rodriguez et al. ..... 112/470.05
6,164,224 A * 12/2000 Tachikawa et al. ..... 112/470.05

FOREIGN PATENT DOCUMENTS

JP 2765113 4/1998

* cited by examiner

*Primary Examiner*—Gary L Welch
*Assistant Examiner*—Nathan E Durham
(74) *Attorney, Agent, or Firm*—Nields, Lemack & Frame, LLC

(57) ABSTRACT

In a sewing machine having an automatic thread cutting mechanism, a situation of a thread cutting operation is detected in power-OFF to continuously carry out a proper operation when a power supply is turned ON again after sudden power-OFF.

In a sewing machine having an automatic thread cutting mechanism, there is provided means for detecting an operation situation of the automatic thread cutting mechanism when a power supply is turned ON. Based on a signal for the detection, the automatic thread cutting mechanism is operated to complete a thread cutting operation and to carry out a control to return into an initial state when a stop is performed with the thread cutting mechanism in power-ON executing the thread cutting work.

5 Claims, 12 Drawing Sheets

(a)

(b)

SEWING MACHINE HAVING AUTOMATIC THREAD CUTTING DEVICE

BACKGROUND OF THE INVENTION

1. Field of the Invention

The present invention relates to a sewing machine having an automatic thread cutting mechanism, and more particularly to a sewing machine having an automatic thread cutting device which can detect whether or not a thread cutting operation is being carried out in an OFF operation of a power supply when the power supply is turned ON again after the power supply is suddenly turned OFF and can be operated to be returned into a non-thread cutting state if the thread cutting operation is being carried out.

2. Related Art

Japanese Patent No. 2765113 has disclosed a technique in the stoppage of a thread cutting operation in the middle in a thread cutting device of a sewing machine. Referring to the contents of the patent, in the case in which a motor is stopped by a tension of a thread during the thread cutting operation, the motor is started again, thereby completing the thread cutting operation.

However, there is a possibility that a power supply might be suddenly turned OFF for various reasons, that is, a service interruption, power-OFF caused by a careless mistake in a switching operation or forcible power-OFF caused by the generation of an emergency such as a dangerous state during a thermal cutting operation.

In the technique, there is no guarantee that a proper operation is carried out in such a case. The technique according to the patent can be simply applied if the power supply is turned ON and the motor is stopped by an external force.

In the case in which the power supply is turned OFF in the thread cutting operation, therefore, it is necessary to carry out a work for removing a thread from the thread cutting device and reattaching the thread depending on the state of the thread cutting operation immediately after the power supply is turned OFF.

SUMMARY OF THE INVENTION

It is an object of the invention to provide an apparatus for detecting an operating state of a thread cutting device and bringing a subsequent return to a normal operation in the case in which a power supply of a sewing machine is turned OFF when the power supply of the sewing machine is ON.

A sewing machine having an automatic thread cutting mechanism according to the invention comprises state detecting means for detecting whether the automatic thread cutting mechanism is in a thread cutting working state or in a non-thread cutting working state, and control means for controlling the automatic thread cutting mechanism to be returned into the non-thread cutting working state in the case in which the state detecting means detects when a power supply is turned ON that the thread cutting mechanism is in the thread cutting working state.

Usually, the thread cutting work is carried out in accordance with an operating command of an operator. The sewing machine usually comprises a thread cutting switch and when the operator manipulates the switch, a thread cutting command signal is output so that a thread cutting operation is executed. The thread cutting command signal may be output from a control device. The thread cutting mechanism carries out an operation for working in response to the thread cutting command signal in an initial state and executing the thread cutting work to be returned into an original initial state. The thread cutting working state means a sequential state where the thread cutting command signal is output at first and the thread cutting operation is then completed, and the thread cutting mechanism is returned into the original initial state. The non-thread cutting working state means a state other than the thread cutting working state, that is usually the same as the initial state.

In the invention, in the case in which the automatic thread cutting mechanism is in the thread cutting working state when the power supply is turned ON, the thread cutting mechanism is controlled to be returned into the non-thread cutting working state. Even if the power supply is turned OFF during the thread cutting work, therefore, the thread cutting mechanism will be automatically returned into the initial state when the power supply will be turned ON again. Consequently, it is not necessary to carry out a work for reattaching a thread.

In the return into the non-thread cutting working state, the return may be carried out after the thread cutting mechanism is caused to complete the thread cutting work, or the return into the initial state may be exactly carried out without the thread cutting mechanism completing the thread cutting work. In general, the thread cutting mechanism usually uses a driving source of the sewing machine as a power source. In this case, it is preferable that the initial state should be returned after the completion of the thread cutting work. In the case in which another power device is used as the power source of the thread cutting mechanism, it is possible to return into the initial state without completing the thread cutting work by carrying out a reverse rotating operation.

In some cases, for example when the driving source of the sewing machine is used as the power source of the thread cutting mechanism, a slight time is required for an interlocking operation of the driving source of the sewing machine and the thread cutting mechanism. Therefore, there is a time lag before the thread cutting mechanism is actually operated after receiving the thread cutting command. By detecting the time lag through the state detecting means, it is also possible to make the operation different depending on as to whether the thread cutting working state is in the time lag state or passes the time lag state. For example, in the case in which the automatic thread cutting mechanism is in the time lag state when the power supply is turned ON, it is possible to return into the non-thread cutting working state without causing the thread cutting mechanism to complete the thread cutting work. Furthermore, it is also possible to have a structure in which the thread cutting mechanism is caused to complete the thread cutting work and is thus returned into the non-thread cutting working state in the case in which the time lag state is over.

The automatic thread cutting mechanism includes a moving knife to be reciprocated, a fixed knife for cutting a thread together with the moving knife, a main driving arm for reciprocating the moving knife, and a knife driving cam coupled only in thread cutting and driving the main driving arm, and the working detecting means detects that the main driving arm and the knife driving cam can be coupled to each other, thereby detecting whether the automatic thread cutting mechanism is in the thread cutting working state or not.

DETAILED DESCRIPTION OF THE PREFERRED EMBODIMENTS

An embodiment according to the invention will be described below with reference to the drawings.

First of all, description will be given to a summary of a structure with reference to FIGS. 11 and 12.

Figure 12:
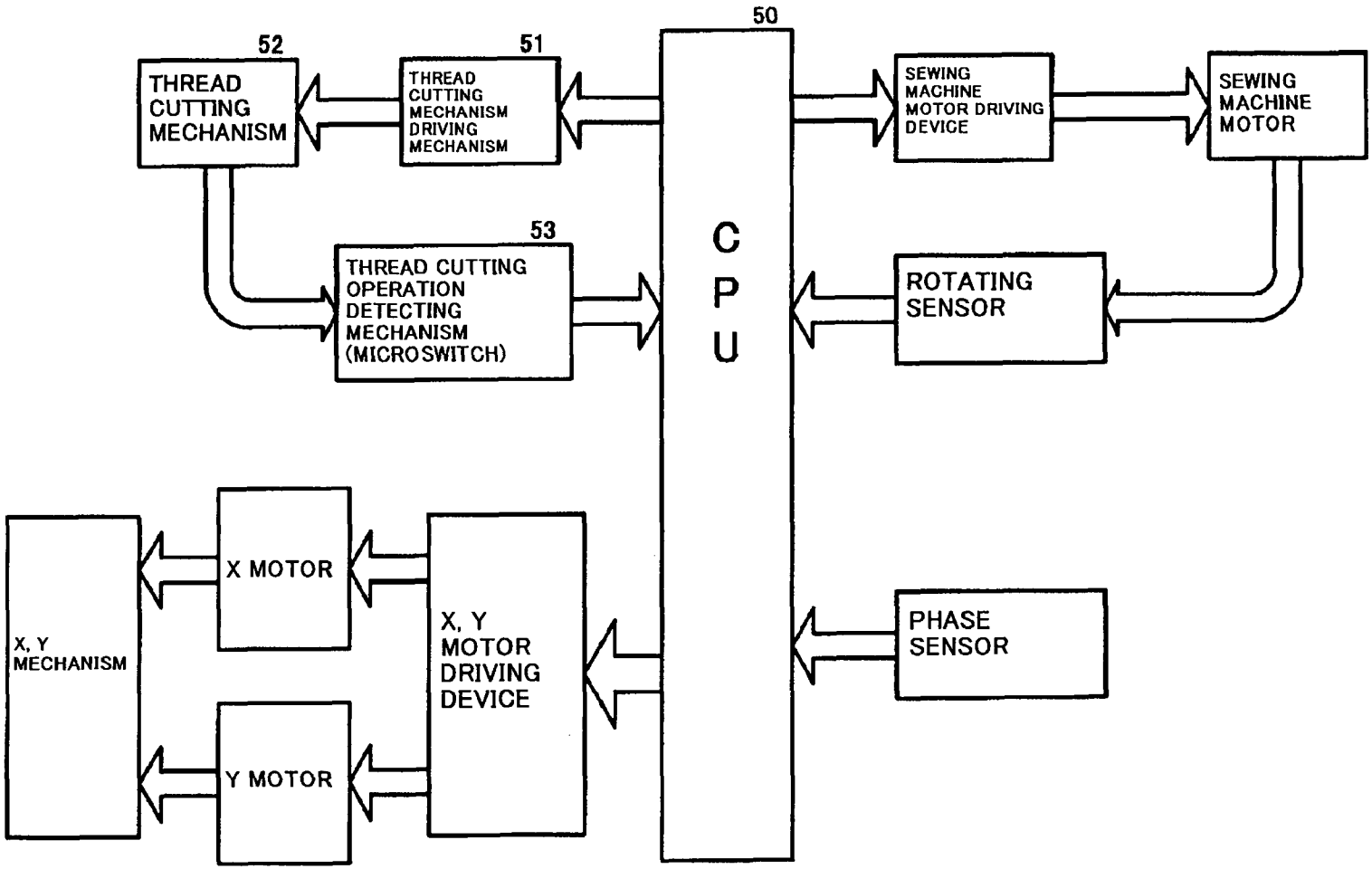
FIG. 12 is a block diagram according to the invention.

In FIG. 12, a CPU 50 controls a whole sewing machine, and furthermore, controls a thread cutting mechanism 52 through a thread cutting mechanism driving mechanism 51 to cut a thread. Whether the thread cutting mechanism 52 is carrying out a thread cutting work is detected by a thread cutting operation detecting mechanism 53 and a signal is sent to the CPU 50.

The thread cutting operation by the thread cutting mechanism 52 is carried out by an operator's manipulation of a thread cutting operation switch (not shown). In addition, it is also possible to have such a structure that the thread cutting operation is carried out in response to a command given from the CPU 50 or other devices. The sewing machine starts to work by an operation of a power ON switch (not shown) of the sewing machine.

Figure 11:
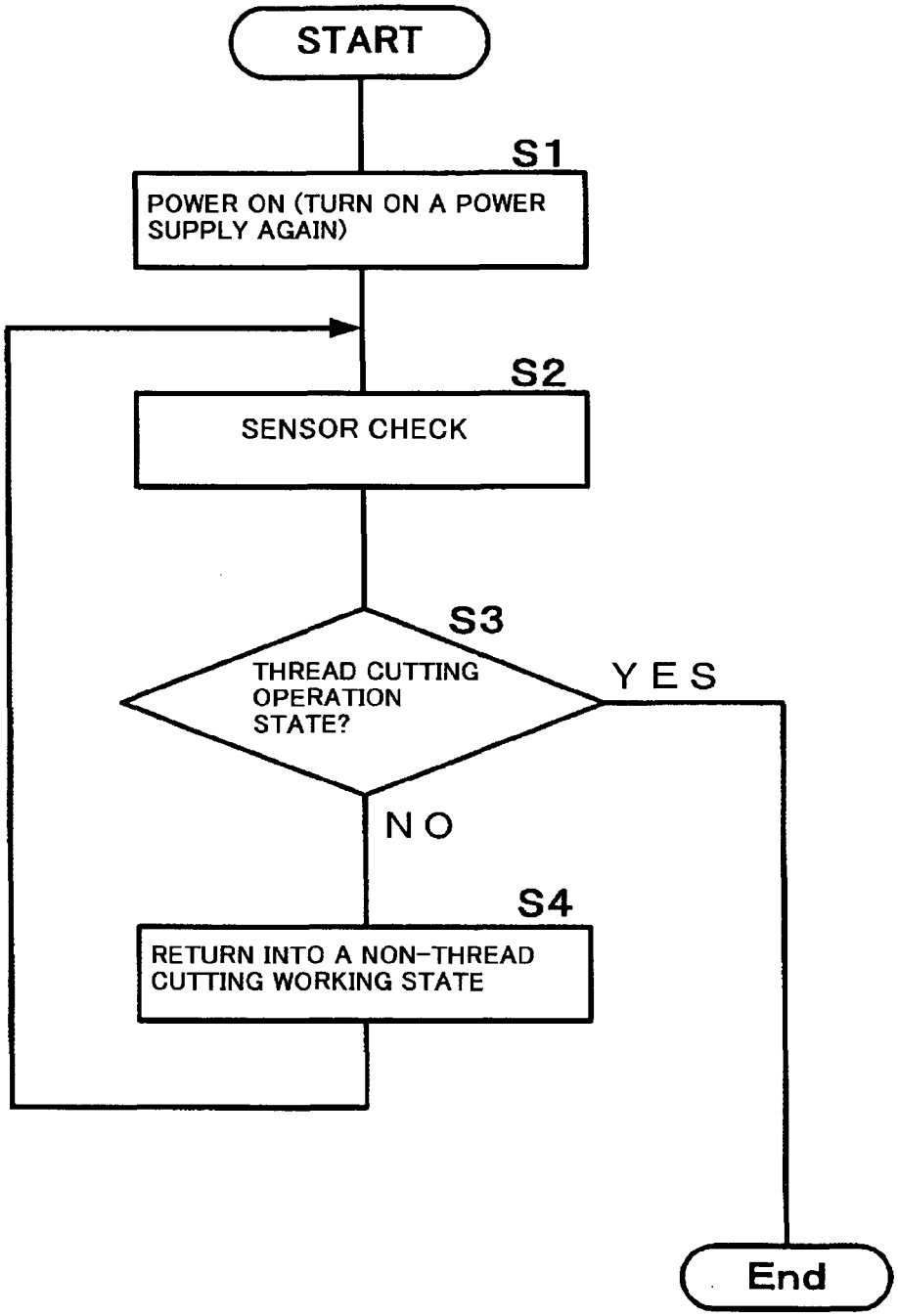
FIG. 11 is a flowchart according to the invention.

In the embodiment, as shown in FIG. 11, a check is carried out by the thread cutting operation detecting mechanism 53 (Step S2) when a power supply is turned ON (Step S1), and it is decided whether the thread cutting mechanism 52 is in a thread cutting operation state or not (Step S3). If it is in the thread cutting operation state, the thread cutting mechanism 52 is returned into a non-thread cutting operation state, that is, an initial state (Step S4). If it is not in the thread cutting operation state, the processing ends.

At the Step S4, a return to the initial state is carried out after the thread cutting operation is completed in the embodiment. In the embodiment, a driving device for the sewing machine is utilized as a power of the thread cutting mechanism 52 and it needs a complicated mechanism and not practical to make the thread cutting mechanism 52 carry out a reverse rotating operation so as to be brought into the initial state.

With such a structure that the driving device of the sewing machine is not used but another dedicated driving source is used as the power of the thread cutting mechanism 52 and the thread cutting mechanism 52 can carry out the reverse rotating operation, the reverse rotating operation can easily be performed and it is also possible to have such a structure as to carry out the return to the initial state without completing the thread cutting operation.

The thread cutting mechanism 52 serves to cut needle and bobbin threads of the sewing machine, and is mainly constituted by a moving knife 5 and a fixed knife 40. Moreover, the thread cutting operation detecting mechanism 53 is a microswitch 27 or a sensor. Furthermore, the thread cutting mechanism driving mechanism 51 serves to reciprocate the moving knife 5 of the thread cutting mechanism, thereby cutting the thread or to bring the thread cutting operation into a stop state. For the member, a main driving arm 34 and a knife driving cam 22 are mainly used.

Next, a mechanism according to the embodiment will be described with reference to FIGS. 1 to 10.

First of all, schematic description will be given to the thread cutting operation of the mechanism.

When a thread cutting command is given, the CPU 50 drives a solenoid 32 so that the main driving arm 34 is pressed down by the driving operation. By the press-down operation, the microswitch 27 is turned ON so that a thread cutting working state is detected. Moreover, a pin 34*b* is engaged with the knife driving cam 22 by the press-down operation. Consequently, the thread cutting mechanism 52 is coupled to a lower shaft 21 of the sewing machine and a thread cutting operation is carried out by a driving force of the lower shaft 21. More specifically, the main driving arm 34 is swung by a predetermined number of rotations (two rotations in this example) of the knife driving cam 22. By the swinging operation, a driven arm 18 is swung. By the swinging operation, a driving plate 9 moves linearly and reciprocally and it makes the moving knife 5 moves reciprocally to cut the thread.

Figure 3:
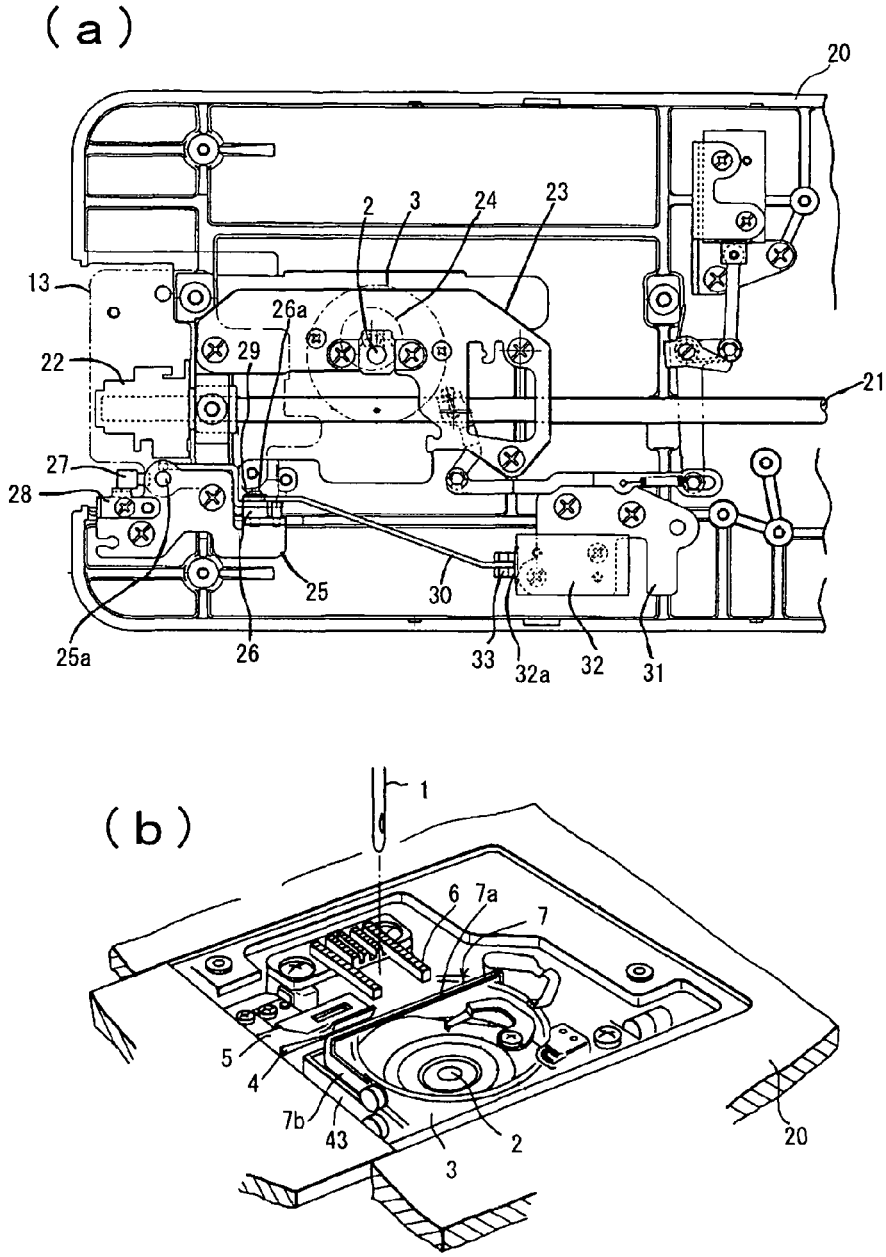

The thread cutting mechanism 52 is incorporated in portions of a throat plate 49 and an outer rotating hook 3 of a bed 20 of a sewing machine main body. More specifically, as shown in FIG. 3(*a*), the outer rotating hook 3 to be rotated around a hook shaft 2 is disposed on this side of a needle 1 in the bed 20 portion (see FIG. 3(*b*)), the threshold cutting mechanism is disposed around the outer rotating hook 3 and a catching mechanism and a pressing mechanism are disposed together with the thread cutting mechanism. A feed dog 6 is disposed movably in vertical and horizontal directions on an inner side of the needle 1. Moreover, an inner rotating hook 38 is accommodated in the outer rotating hook 3 and a bobbin 24 having a bobbin thread 29*d* wound therearound is accommodated in the inner rotating hook 38 [see FIG. 1(*a*)]. A thread pressing member 7 is disposed in a direction of a motion of a catching member 4 and the moving knife 5 across the outer rotating hook 3 on this side of the needle 1.

Figure 1:
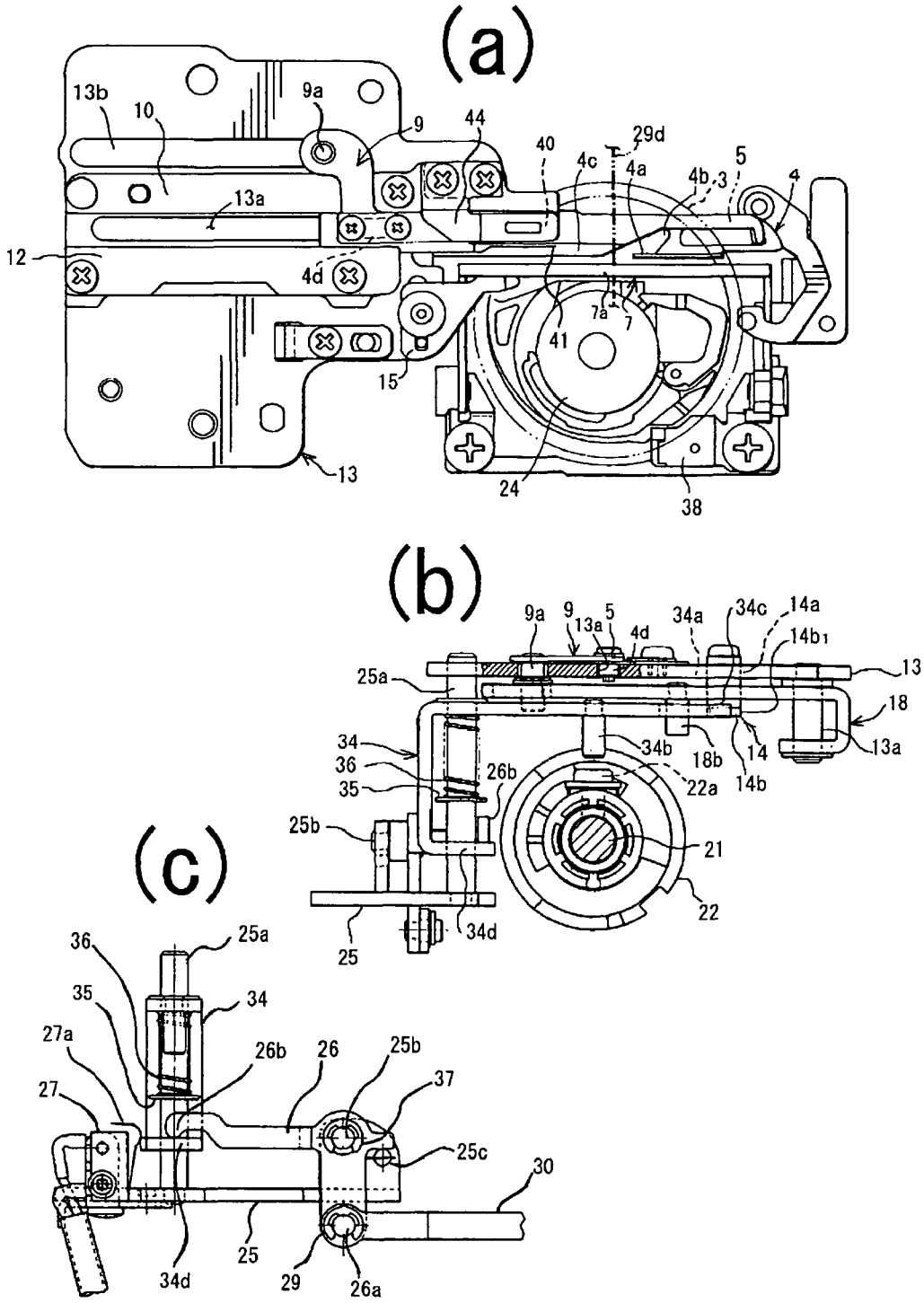
FIG. 1(*a*) is a plan view showing the periphery of an outer rotating hook comprising a thread cutting mechanism, a catching mechanism and a pressing mechanism according to the invention, FIG. 1(*b*) is a front view showing a main part of a state in which a main driving arm is positioned in an upper part according to the invention, and FIG. 1(*c*) is a side view of FIG. 1(*b*), FIG. 2(*a*) is a front view showing a main part of a state in which the main driving arm is positioned in a lower part according to the invention, FIG. 2(*b*) is a side view of (a) and FIG. 2(*c*) is a perspective view showing the thread cutting mechanism, FIG. 3(*a*) is a plan view seen from a bottom face of a bed and FIG. 3(*b*) is a perspective view showing the periphery of the outer rotating hook, FIG. 4(*a*) is a sectional view showing a main part of the thread cutting mechanism and FIG. 4(*b*) is a functional view showing an operation of the thread cutting mechanism, FIG. 5(*a*) is a plan view showing the thread cutting mechanism and FIG. 5(*b*) is a rear view showing the thread cutting mechanism, FIG. 6(*a*) is a rear view showing the operation of the thread cutting mechanism, FIG. 6(*b*) is a rear view showing the operation of the thread cutting mechanism, and FIG. 6(*c*) is an end view taken along X-X in FIG. 6(*b*), FIG. 7(*a*) is a functional view showing an initial stage of the thread cutting mechanism and FIG. 7(*b*) is a side view of FIG. 7(*a*), FIG. 8(*a*) is a functional view showing a middle stage of the thread cutting mechanism and FIG. 8(*b*) is a side view of FIG. 8(*a*), FIG. 9(*a*) is a functional view showing a completion stage of the thread cutting mechanism and FIG. 9(*b*) is a side view of FIG. 9(*a*), FIGS. 10(*a*) and 10(*b*) are schematic views showing the step of cutting a bobbin thread according to the invention.
Figure 5:
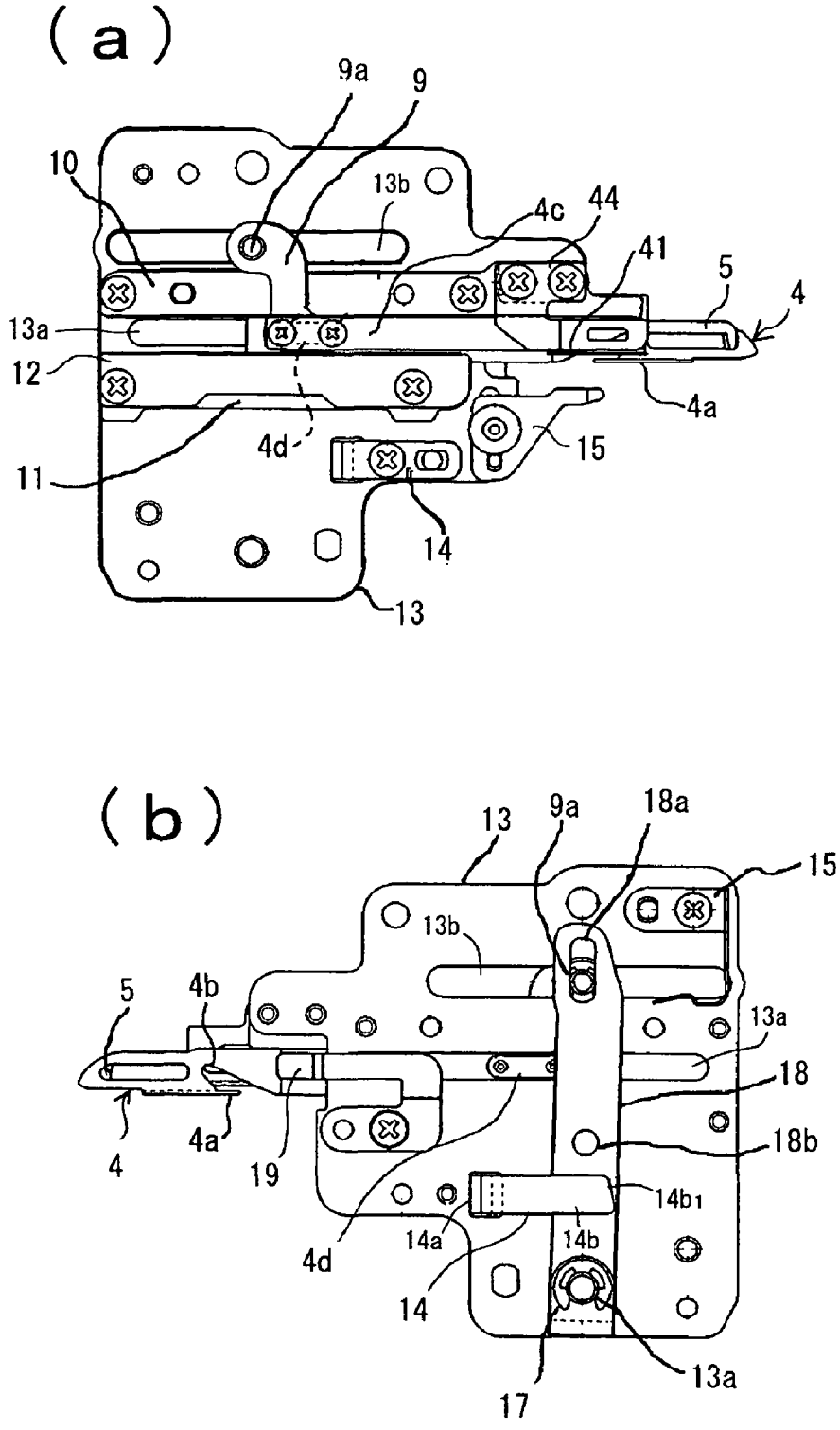

The thread cutting mechanism is mainly constituted by the moving knife 5 and the fixed knife 40, and the catching mechanism and the pressing mechanism are included in addition thereto. The moving knife 5 and the fixed knife 40 in the thread cutting mechanism and the catching member 4 in the catching mechanism are provided on one base plate 13 as shown in FIGS. 1(*a*), 2(*c*) and 5. More specifically, the catching member 4 and the moving knife 5 are coupled to the driving plate 9 with screws, and are held slidably in a transverse direction over the base plate 13 by means of guide members 10, 11 and 12 [see FIG. 5(*a*)]. The catching member 4 and the moving knife 5 are formed like thin plates or almost band plates. In the catching member 4, as shown in FIGS. 1 and 5, a catching portion 4*a* for a needle thread 29*u* and a bobbin thread 29*d* is formed on a tip in a longitudinal direction of a sliding plate portion 4*c* taking a shape of a band plate, and a catching and cutting portion 4*b* is formed in the sliding plate portion 4*c* in the vicinity of a place in which the catching portion 4*a* is formed.

The catching portion 4*a* is formed like an almost triangular plate, and is bent almost perpendicularly to a flat surface of the sliding plate portion 4*c* from a side edge on one end in a transverse direction in the vicinity of the tip in the longitudinal direction of the sliding plate portion 4*c*. Moreover, the catching and cutting portion 4*b* is cut to take an almost U shape from one edge in the transverse direction of the sliding plate portion 4*c* toward the tip in the longitudinal direction of the sliding plate portion 4*c* [see FIG. 5(*b*)].

In the catching member 4 in the catching mechanism, the needle thread 29*u* and the bobbin thread 29*d* which are engaged in the catching portion 4*a* enter the catching and cutting portion 4*b* and are transferred to a lower surface side of the fixed knife 40. The catching portion 4*a* is formed to take an almost triangular shape as described above. Moreover, an inner part of the catching and cutting portion 4*b* is obtained by cutting the catching member 4 toward the tip in the longitudinal direction, and the needle thread 29*u* and the bobbin thread 29*d* which are caught by the catching portion 4*a* can be reliably engaged with each other so as to slip off with difficulty. The moving knife 5 is formed like a band plate and is provided to be almost hook-shaped in a tip portion in a longitudinal direction thereof. In the vicinity of a knife blade portion of the moving knife 5, a region having a close part to the tip which is narrowed in a transverse direction is formed and the knife blade portion in the tip part is bent almost rectangularly.

Figure 2:
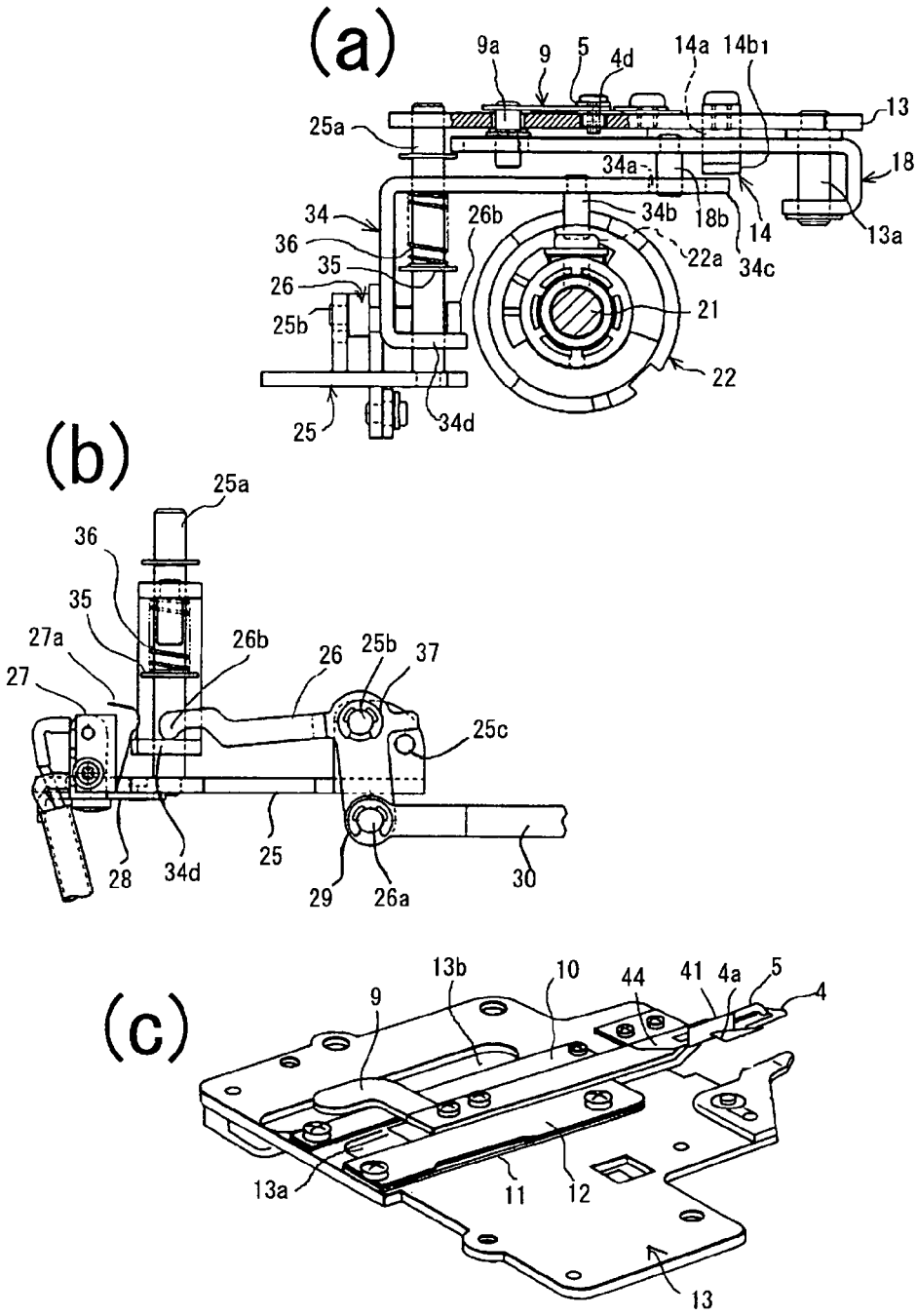

The catching member 4 and the moving knife 5 are superposed in a vertical direction and are fixed and integrated with a fixing tool such as a screw as shown in FIGS. 2(*c*) and 5. The catching member 4 can be reciprocated together with the moving knife 5 in the longitudinal direction with respect to the base plate 13. As shown in FIGS. 2 and 5, the base plate 13 is provided with a guide groove 13*a* for causing the catching member 4 to be reciprocated in the longitudinal direction. The guide groove 13*a* is formed to take a shape of an almost rectangular slot.

A slide member 4*d* is inserted in the guide groove 13*a* and can be freely reciprocated in a longitudinal direction of the slot in the guide groove 13*a*. The slide member 4*d* is a small block taking a shape of an almost rectangular parallelepiped, and the slide member 4*d* and the sliding plate portion 4*c* of the catching member 4 are fixed together with the moving knife 5 with screws. With the reciprocation of the slide member 4*d* in the guide groove 13*a*, the catching member 4 and the moving knife 5 are reciprocated in the longitudinal direction.

The fixed knife 40 and a thread guide 41 are disposed between the moving knife 5 and the catching member 4 so as to be positioned below the moving knife 5. A moving knife pressing portion 44 is disposed above the moving knife 5 so as to pressurize the moving knife 5. The fixed knife, the thread guide 41 and the moving knife pressing portion 44 are fixed onto the base plate 13 with a fixing tool such as a screw (see FIG. 5).

Next, the driving plate 9 is fixed to the catching member 4 and the moving knife 5 [see FIGS. 2 and 5(*a*)]. The driven arm 18 attached to the back side of the base plate 13 is pivotally coupled to the driving plate 9. More specifically, the driven arm 18 has one end in a longitudinal direction which is pivotally supported on the base plate 13 and can be freely swung around a pivotal portion thereof [see FIGS. 6(*a*) and 6(*b*)]. The driven arm 18 and the driving plate 9 are pivotally coupled to each other through pin bonding. A pin 9*a* is attached to the driving plate 9 and a slot 18*a* is formed on the driven arm 18, and the pin 9*a* is inserted in the slot 18*a* with a play. The driving plate 9 and the driven arm 18 are pivotally coupled to each other by the pin bonding through an auxiliary guide groove 13*b* taking a shape of a through slot which is formed on the base plate 13.

The pin 9*a* may be attached to the driven arm 18 and the slot 18*a* may be formed on the driving plate 9 side. The driven arm 18 is pivotally coupled to the main driving arm 34 through the pin bonding. The pivotal coupling structure is also obtained by the pin and the slot as described above. In the embodiment, a pin 18*b* is attached to an almost middle portion in the longitudinal direction of the driven arm 18 and a slot 34*a* is formed in an end portion in the longitudinal direction of the main driving arm 34 [see FIGS. 2 and 6].

The main driving arm 34 serves to carry out a regular cam operation by means of the knife driving cam 22 which will be described below. The knife driving cam 22 is attached to the lower shaft 21 attached into the bed 20 as shown in FIGS. 2 and 3(*a*), and is rotated together with the lower shaft 21, thereby transmitting the cam operation to the main driving arm 34. The catching member 4 and the moving knife 5 are reciprocated in the longitudinal direction through the driven arm 18 and the driving plate 9 from the main driving arm 34 so that a thread cutting operation can be carried out. Moreover, a power can be transmitted from the knife driving cam 22 to the driving plate 9 in response to a thread cutting signal. In a normal sewing state, furthermore, the transmission of the power is blocked and the catching member 4 and the moving knife 5 are stopped in a position of a leftmost point in FIG. 1.

In the drawings, the reference numeral 14 denotes a stopper for the thread cutting operation. Moreover, the reference numeral 15 denotes a reverse rotation stopper for the inner rotating hook 38. The needle thread 29*u* is caught by a blade tip of the outer rotating hook 3 (which is not shown), and turns around the outer periphery of the inner hook 38 and slips out of the reverse rotation stopper 15, and is then hung and caught on the catching portion 4*a* of the catching member 4 in the catching mechanism standing by on a rightmost point in FIG. 1. Thereafter, the needle thread 29*u* is led to a thread cutting position by the movement of the catching member 4 and the guide of the thread guide 41.

A portion for transmitting a power from the knife driving cam 22 to the driving plate 9 can transmit the power by generating a thread cutting signal as described above. More specifically, as shown in FIGS. 2(*a*) and 2(*b*), when the thread cutting signal is generated, the main driving arm 34 approaches the knife driving cam 22 and the pin 34*b* provided on the main driving arm 34 is inserted in a groove-shaped guide portion 22*a* of the knife driving cam 22 so that the cam operation of the knife driving cam 22 is transmitted to the catching member 4 and the moving knife 5 through the main driving arm 34, the driven arm 18 and the driving plate 9 and they are caused to carry out a reciprocation. In the normal sewing state, the knife driving cam 22 and the main driving arm 34 are not coupled to each other and the transmission of the power is blocked, and the catching member 4 and the moving knife 5 are brought into a stop state in a position of a leftmost point in FIG. 1.

The position of the leftmost point is an initial position, and when they are set at the point, the thread cutting mechanism 52 is in an initial state and in a non-thread cutting working state.

Figure 4:
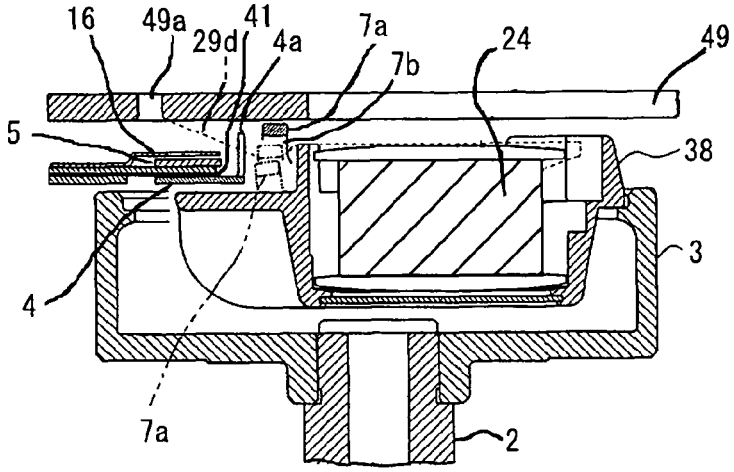
Figure 4:
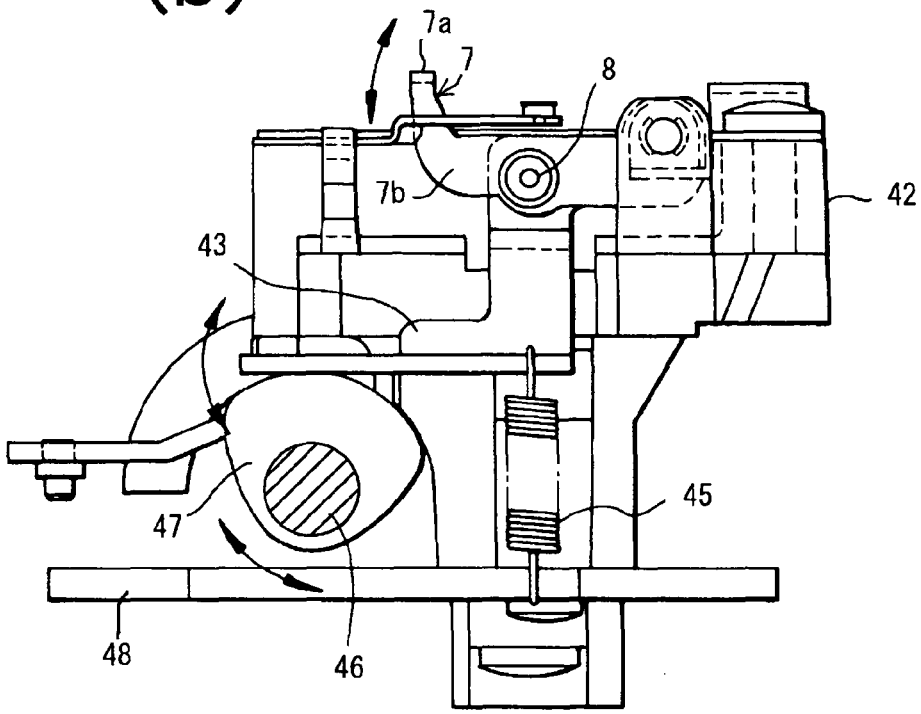

Referring to the pressing mechanism, the thread pressing member 7 is pivotally coupled to a hook chamber cover 42 through a pin 8 so as to be freely swingable. The thread pressing member 7 is constituted by a shaft-shaped pressing portion 7*a* and rocking arm portions 7*b* and 7*b*. The shaft-shaped pressing portion 7*a* takes a shape of an almost band plate and serves to press the bobbin thread 29*d*. Referring to a driving mechanism for rocking the shaft-shaped pressing portion 7*a* of the thread pressing member 7 in the pressing mechanism in a vertical direction, the rocking arm portions 7*b* and 7*b* are pivotally coupled to a thread pressing table 43 for rocking the shaft-shaped pressing portion 7*a* in the vertical direction as shown in FIG. 4(*b*).

The thread pressing table 43 is coupled to a driving source and a spring 45 is hung between the thread pressing table 43 and a hook attaching plate 48, and the thread pressing table 43 is elastically energized downward. A thread pressing cam 47 is attached to a lower shaft 46 and is rotated with the rotation of the lower shaft 46, and the thread pressing table 43 is reciprocated in the vertical direction in accordance with the rotation of the thread pressing cam 47 so that the thread pressing member 7 carries out a swinging motion in the vertical direction. The lower shaft 46 is separate from the lower shaft 21 for driving the sewing operation of the sewing machine. The lower shaft 46 is rotated in response to a thread cutting signal for cutting the bobbin thread 29*d*. There are various driving mechanisms for the thread pressing member 7 and the mechanism is not restricted.

The shaft-shaped pressing portion 7*a* of the thread pressing member 7 is provided between the catching member 4 and a horizontal rotating hook as described above and crosses an upper part of a path for the bobbin thread 29*d* communicating from the bobbin 24 in the horizontal rotating hook to a needle hole 30*a* of the throat plate 49. Furthermore, the shaft-shaped pressing portion 7*a* is disposed along a reciprocating motion path for the catching member 4 (and the moving knife 5).

Figure 7:
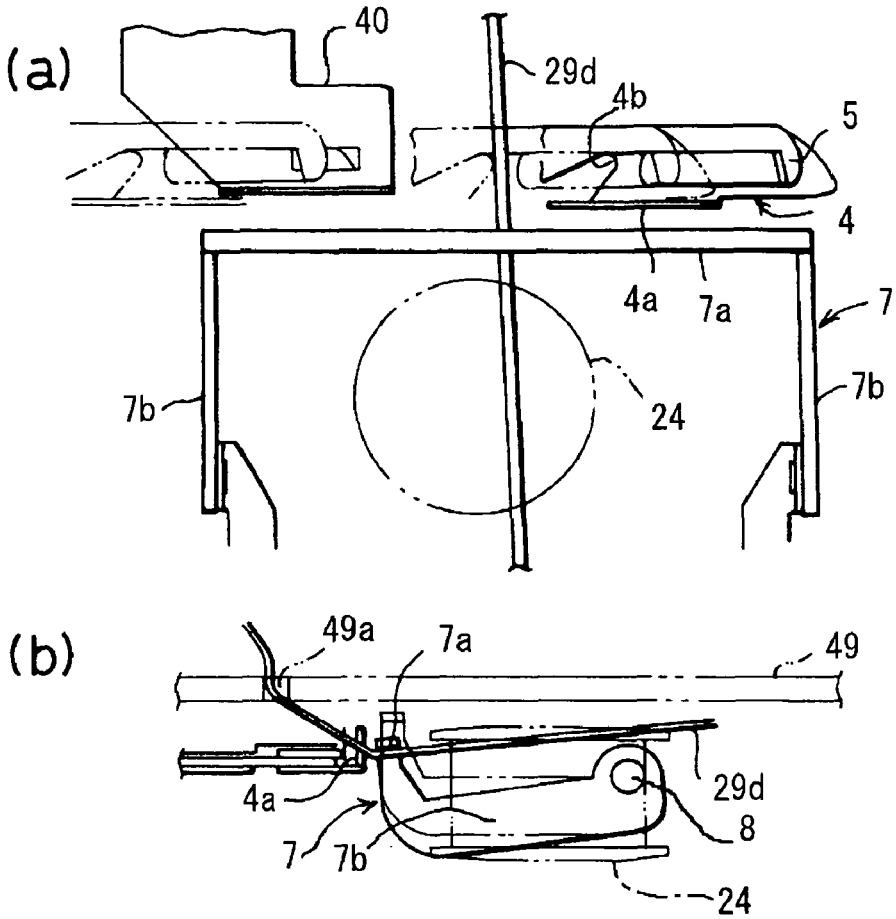
Figure 8:
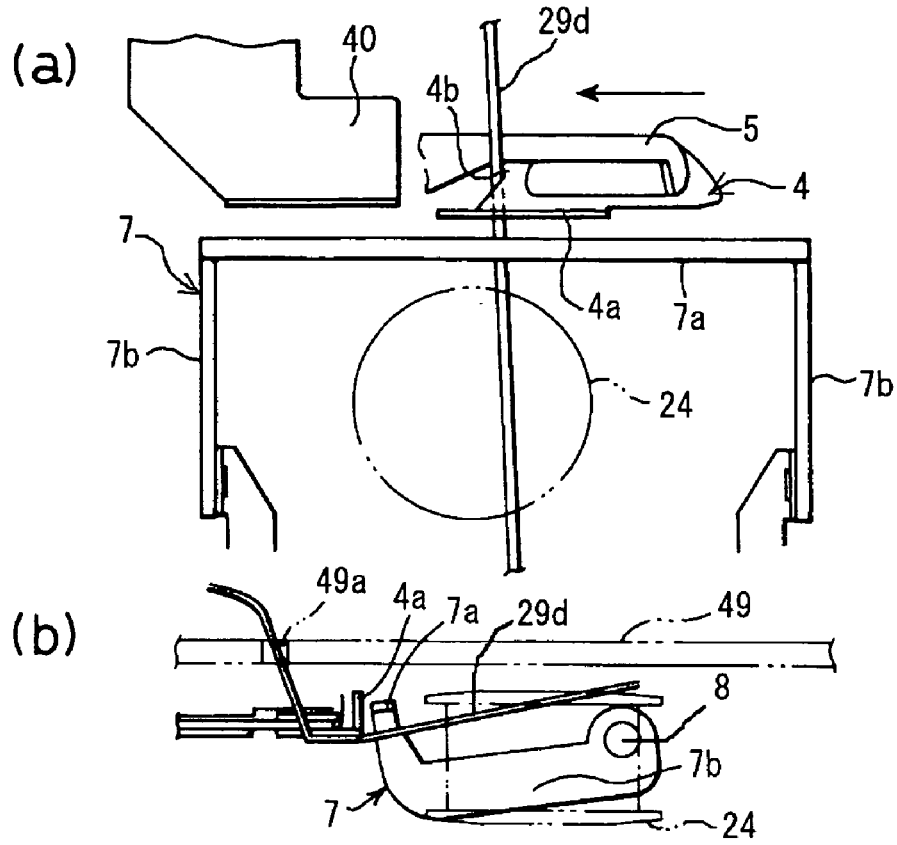
Figure 9:
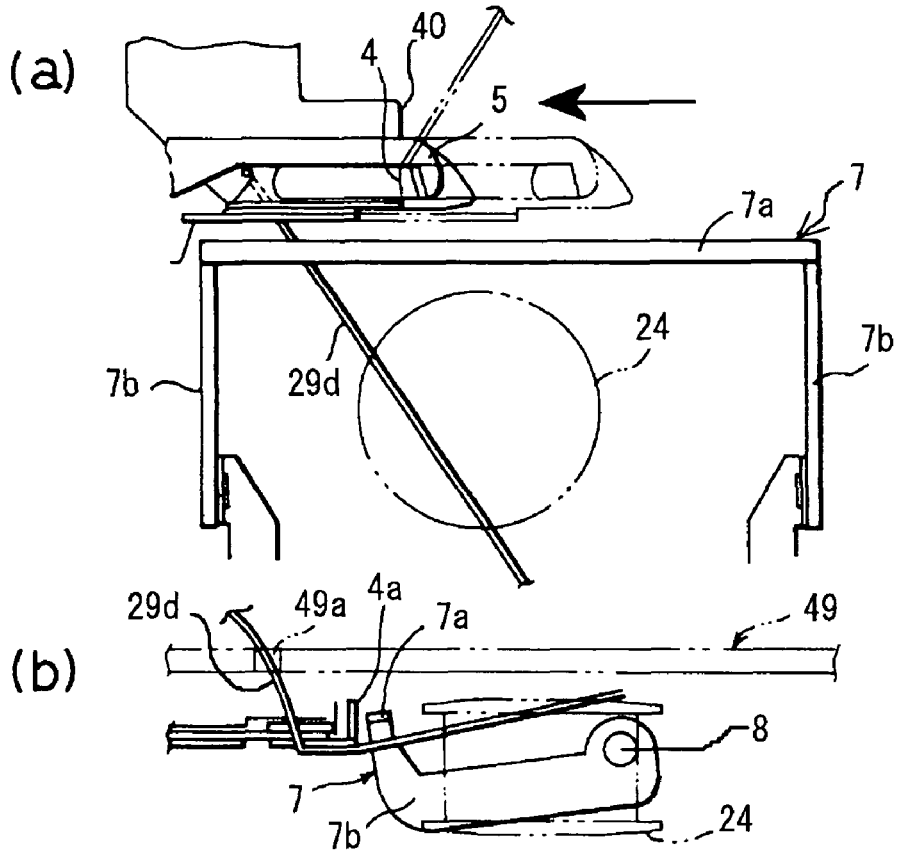
Figure 10:
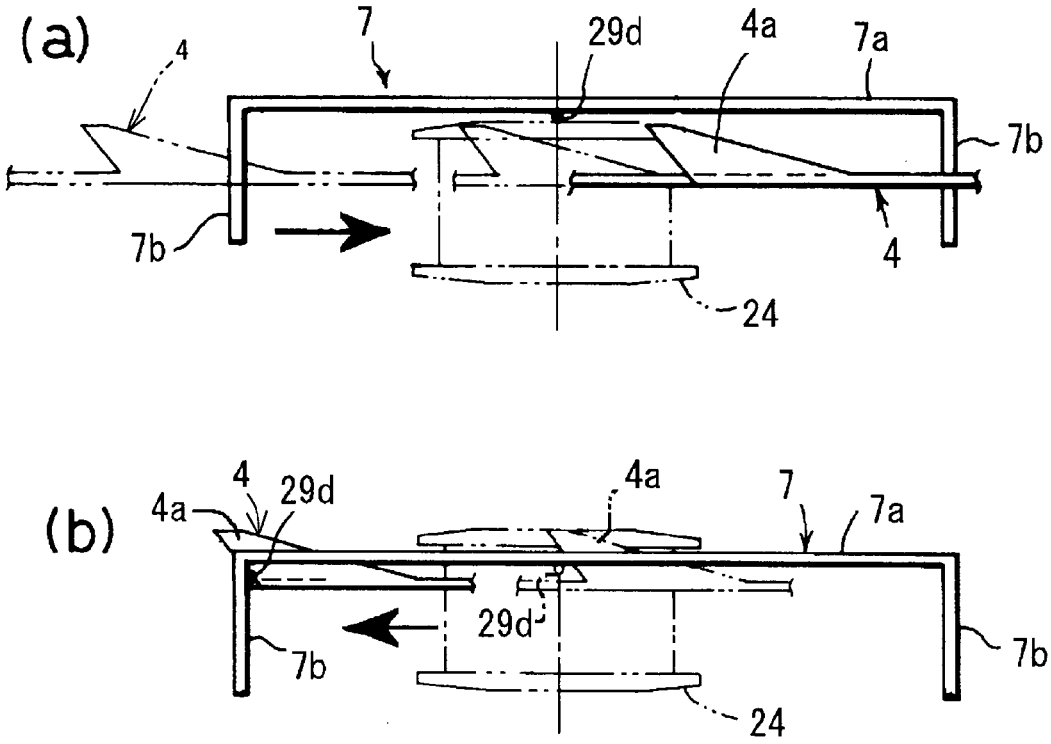

A process for the thread cutting operation in the thread cutting mechanism will be described with reference to FIGS. 7 to 9 and 10. (a) in each of FIGS. 7 to 9 is a schematic view showing the thread pressing member 7 portion of FIG. 1(*a*) as seen from a plane. Furthermore, (b) in each of FIGS. 7 to 9 is a schematic view seen from a side of the drawings (a). Moreover, FIG. 10 is a schematic view showing a state in which the catching member 4 catches the bobbin thread through the thread pressing member 7.

First of all, at a first step, the tips of the catching member 4 and the moving knife 5 are positioned on a left end in FIG. 7(*a*), are set in a non-operation state and are accommodated in the base plate 13. The moving knife 5 in the non-operation state is displayed in an imaginary line in FIG. 7(A). At this time, the shaft-shaped pressing portion 7*a* of the thread pressing member 7 of the pressing mechanism is positioned above the catching portion 4*a* of the catching member 4 and the bobbin thread 29*d* is also present above a top of the catching portion 4*a* [see FIG. 10(*a*)].

At a second step, next, a thread cutting instruction for the bobbin thread 29*d* is given so that the moving knife 5 is moved in a going direction of the reciprocation together with the catching member 4. The shaft-shaped pressing portion 7*a* is positioned above the catching portion 4*a* in the middle of the movement in the going direction of the catching member 4 and the moving knife 5. At a third step, then, the movement is stopped when the catching portion 4*a* reaches an end point in the going direction. Moreover, the shaft-shaped pressing portion 7*a* is moved downward to a lower position than the top of the catching portion 4*a*, thereby pressing the bobbin thread 29*d* downward [see FIG. 7(*b*)].

At a fourth step, subsequently, the movement is started from the position of the end point in the going direction to a returning direction and the catching portion 4*a* catches the bobbin thread 29*d* in the middle so that the bobbin thread 29*d* enters the catching and cutting portion 4*b* to cause the catching state of the bobbin thread 29*d* to be more reliable [see FIGS. 8(*a*) and 8(*b*)]. At a fifth step, then, the bobbin thread 29*d* thus caught is moved in the returning direction together with the catching member 4 and is guided to a position of the fixed knife 40. Thereafter, the moving knife 5 and the fixed knife 40 cut the bobbin thread 29*d* which is caught [see FIGS. 9(*a*), 9(*b*) and 10(*b*)]. When the cutting instruction is cancelled, the shaft-shaped pressing portion 7*a* of the thread pressing member 7 returns to an original height so that the bobbin thread 29*d* is not caught by the catching member 4.

Next, description will be given to the thread cutting mechanism driving mechanism 51. FIGS. 1(*b*) and 1(*c*) show a state in which the thread cutting mechanism does not carry out a thread cutting operation and the moving knife 5 and the catching member 4 are set in a stopping state, and FIGS. 2(*a*) and 2(*b*) show a state in which the moving knife 5 and the catching member 4 are reciprocated.

With the structure, first of all, the lower shaft 21 is rotatably supported on the bed 20 and the knife driving cam 22 is attached into an end portion in an axial direction of the lower shaft 21. The knife driving cam 22 is provided with the groove-shaped guide portion 22*a*, and a thread cutting signal is generated so that a power can be transmitted together with the driving plate 9. In the normal sewing state, moreover, the transmission of the power is blocked and the catching member 4 and the moving knife 5 are set in a non-thread cutting operation state (in which the thread is not cut) and are stopped in an initial position. The initial position is set in a position of a leftmost point in FIG. 1(*a*). Moreover, a driving arm shaft table 25 is disposed in the bed 20 and a driving link 26 is pivotally coupled to the driving arm shaft table 25 rotatably in a vertical direction over a perpendicular plane. Furthermore, the microswitch 27 is attached as a thread cutting operation detecting mechanism which will be described below to the driving arm shaft table 25 through a switch attaching plate 28.

One end side in a longitudinal direction of a switching rod 30 is pivotally coupled rotatably through an E type snap ring 29 to a pin 26*a* provided on one end side of the driving link 26, and furthermore, the solenoid 32 is coupled to the other end side in the longitudinal direction of the switching rod 30. The solenoid 32 is attached to the bed 20 through a solenoid attaching plate 31. The switching rod 30 and the solenoid 32 are pivotally coupled to a plunger 32*a* of the solenoid 32 through a pin 33. When the solenoid 32 is operated so that the plunger 32*a* is sucked as will be described below, accordingly, the driving link 26 executes a predetermined operation through the switching rod 30.

A shaft 25*a* is infixed into the driving arm shaft table 25. A rotating center base portion 34*d* formed on one end side in the longitudinal direction of the main driving arm 34 is formed on the shaft 25*a*. The rotating center base portion 34*d* is formed to take an almost U shape and can slide the shaft 25*a* in two through holes with respect to the shaft 25*a*, and the main driving arm 34 carries out a rotation and a vertical motion by a stable operation with respect to the shaft 25*a*.

The main driving arm 34 is always energized upward and elastically by means of a spring 36 attached to surround the shaft 25*a* and an E type snap ring 35 for supporting a lower end of the spring 36 [see FIGS. 1(*b*) and 1(*c*)]. The slot 34*a* is formed on the opposite side of the rotating center base portion 34*d* in the longitudinal direction of the main driving arm 34. The pin 18*b* of the driven arm 18 is inserted and coupled into the slot 34*a*. Moreover, the pin 34*b* is formed in an almost middle portion in the longitudinal direction of the main driving arm 34.

The pin 34*b* is removed from and inserted into the groove-shaped guide portion 22*a* of the knife driving cam 22 by a moving operation in the vertical direction of the main driving arm 34. As described above, the pin 9*a* of the driving plate 9 is inserted into the slot 18*a* of the driven arm 18. By the rotation of the knife driving cam 22, the main driving arm 34 starts a swinging motion through the pin 34*b* inserted and fitted in the groove-shaped guide portion 22*a*, thereby causing the driven arm 18 to carry out the swinging motion through the pin 18*b* from the slot 34*a*.

Figure 6:
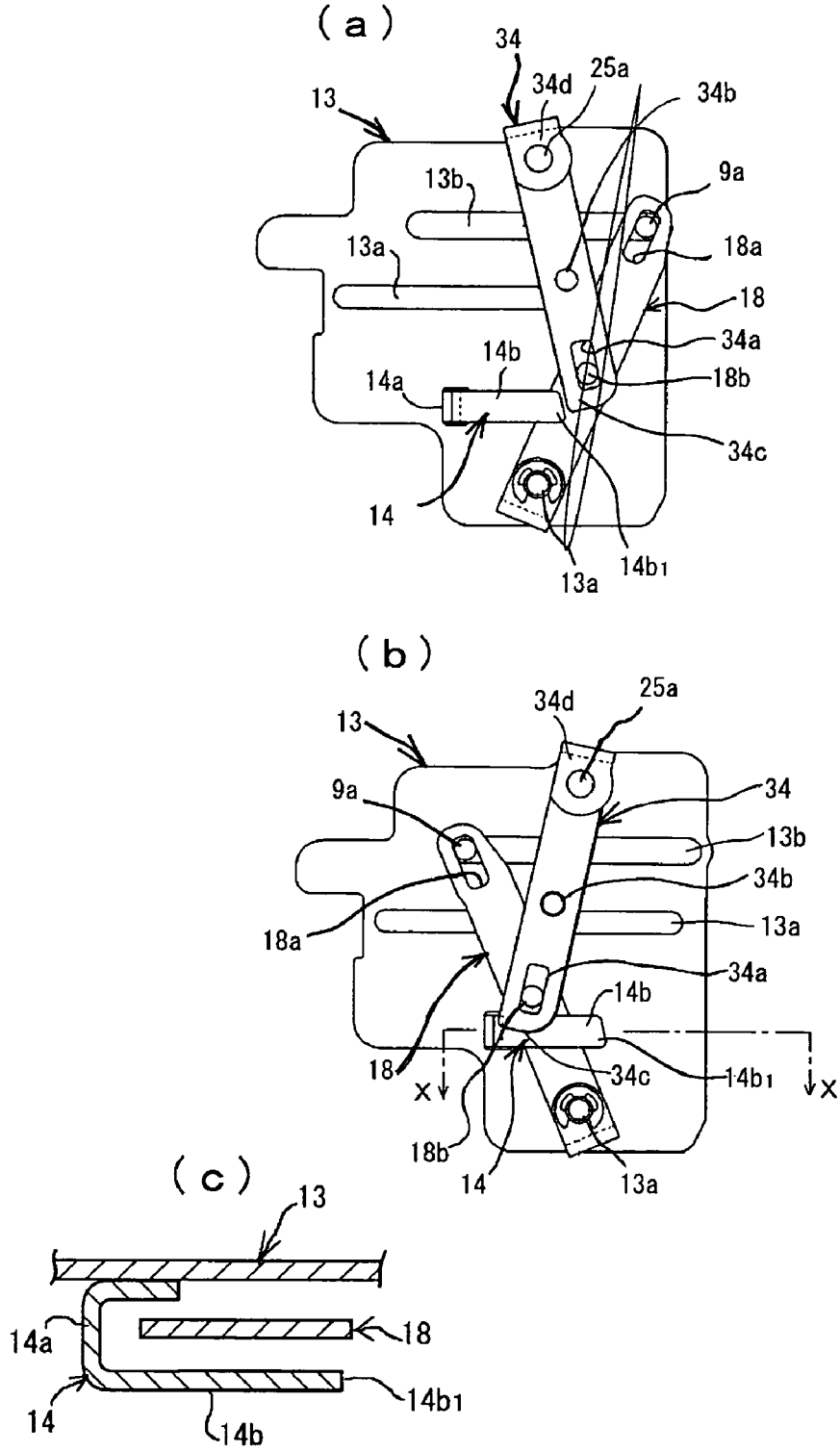

By the swinging motion of the driven arm 18, the driving plate 9 generates a reciprocating motion in a transverse direction through a pivotal coupling portion of the slot 18*a* and the pin 9*a*. Since both the catching member 4 and the moving knife 5 are coupled to the driving plate 9, they are reciprocated with the reciprocation of the driving plate 9 so that a thread cutting operation is carried out. In a state in which the driven arm 18 is separated from a tip portion 14*b*1 of the stopper 14 formed on the base plate 13, the main driving arm 34 is placed in an upper position in an axial direction along the shaft 25*a* and the pin 34*b* of the main driving arm 34 is removed from the groove-shaped guide portion 22*a* of the knife driving cam 22. The stopper 14 is formed on a lower surface side of the base plate 13 so as to take an almost L shape and is constituted by a vertical piece 14*a* and a horizontal piece 14*b* as shown in FIGS. 6(*b*) and 6(*c*). A tip portion of the horizontal piece 14*b* serves as the tip portion 14*b*1.

FIG. 6(*a*) is a view showing the base plate 13 from the lower surface side, and the main driving arm 34 and the driven arm 18 are positioned in such a manner that the moving knife 5 is positioned on an original point where the thread cutting operation has not been carried out. Furthermore, FIG. 6(*b*) shows a state in which the moving knife 5 is protruded most greatly, and the pin 34*b* of the main driving arm 34 is guided to the groove-shaped guide portion 22*a* by the rotation of the knife driving cam 22 so that the main driving arm 34 is moved. Then, a free end provided with the slot 18*a* of the driven arm 18 is moved leftward (toward an outer side of the base plate 13) in FIG. 6(*b*) through a pivotal coupling portion of the slot 34*a* and the pin 18*b*, thereby rotating the driving plate 9 through the pin 9*a* to move the catching member 4 and the moving knife 5 leftward (toward the outer side of the base plate 13).

In this case, the main driving arm 34 is energized to be pulled downward along the shaft 25*a*, and the main driving arm 34 is placed in a different position from the horizontal piece 14*b* of the stopper 14 in a direction of a height [see FIG. 2(*a*)]. Accordingly, the main driving arm 34 can be prevented from being interrupted by the stopper 14 but can carry out the swinging motion. Moreover, the main driving arm 34 is placed in a lower position in the direction of the height and the pin 34*b* is inserted in the groove-shaped guide portion 22*a* of the knife driving cam 22 and is rotated on a lower surface side of the horizontal piece 14*b* of the stopper 14. The pin 34*b* is maintained to be guided into the groove-shaped guide portion 22*a*.

Thus, the moving knife 5 and the catching member 4 are reciprocated by the thread cutting mechanism driving mechanism 51, thereby carrying out the thread cutting operation. In the non-operation of the thread cutting, the tip of the pin 34*b* of the main driving arm 34 is set in a removing state from the groove-shaped guide portion 22*a* of the knife driving cam 22, and a clearance is maintained between the tip of the pin 34*b* and the groove-shaped guide portion 22*a*. More specifically, even if the knife driving cam 22 is rotated, the main driving arm 34 does not carry out the swinging motion. Moreover, the horizontal piece 14*b* of the stopper 14 is on the level with a tip portion 34*c* of the main driving arm 34 and the swinging motion of the main driving arm 34 is stopped and controlled in such a manner that the moving knife 5 can be prevented from being carelessly operated as shown in FIGS. 1(*b*) and 5.

The driving link 26 is almost L-shaped and a bent corner portion thereof is swingably supported through an E type snap ring 37 on a pin 25*b* attached to a rising portion of the driving arm shaft table 25 so as to be a swinging center. The driving link 26 is coupled to the solenoid 32 through the switching rod 30. One of ends of the driving link 26 is engaged, as a pressing end 26*b*, with the rotating center base portion 34*d* of the main driving arm 34 held on the shaft 25*a* so as to freely carry out pressing.

When the solenoid 32 is operated, the switching rod 30 is moved, the driving link 26 is swung and the pressing end 26*b* presses the rotating center base portion 34*d* downward to move the main driving arm 34 downward. Consequently, the pin 34*b* of the main driving arm 34 is inserted in the groove-shaped guide portion 22*a* of the knife driving cam 22 and the main driving arm 34 is operated together with the pin 34*b* in accordance with the groove-shaped guide portion 22*a* of the knife driving cam 22 so that an operation is transmitted from the main driving arm 34 to the driven arm 18 and the driving plate 9, thereby causing the catching member 4 and the moving knife 5 to carry out a reciprocation from the driving plate 9. The solenoid 32 is operated in response to an issuance of a thread cutting instruction. In the drawings, the reference numeral 25*c* denotes a stopper formed on the driving arm shaft table 25 which serves to regulate a swinging range of the driving link 26.

Next, description will be given to a thread cutting operation detecting mechanism to be means for detecting an operating situation of an automatic thread cutting mechanism. More specifically, the microswitch 27 is used for the thread cutting operation detecting mechanism. As described above, the microswitch 27 is fixed to the driving arm shaft table 25 through the switch attaching plate 28, and a microswitch lever 27*a* is swung by the vertical motion of the rotating center base portion 34*d* of the main driving arm 34 [see FIGS. 1(*c*) and 2(*b*)]. Referring to the vertical motion of the main driving arm 34, the microswitch 27 is turned ON/OFF.

With reference to FIG. 2, description will be given to a state in which the moving knife 5 is operated by means of the microswitch 27. The solenoid 32 is operated in response to a thread cutting instruction signal and the driving link 26 is rotated [counterclockwise in FIG. 1(*c*)] through the switching rod 30 so that the main driving arm 34 is pushed downward against an elasticity of the spring 36. The main driving arm 34 is pushed downward so that the microswitch lever 27*a* of the microswitch 27 is switched and a displacement of the main driving arm 34 is detected by means of the microswitch 27. A serial operation is shown in FIGS. 1(*c*) to 2(*b*).

In this state, as shown in FIGS. 1(*b*) to 2(*a*), the main driving arm 34 is pushed downward by the driving link 26 so that the pin 34*b* is also moved downward and the tip of the pin 34*b* is inserted. into the groove-shaped guide portion 22*a* of the knife driving cam 22. Consequently, the rotating operation of the knife driving cam 22 transmits a power to the main driving arm 34, the driven arm 18 and the driving plate 9 respectively so that the catching member 4 and the moving knife 5 execute the thread cutting operation. When the main driving arm 34 is pushed downward by the driving link 26, the tip portion 34*c* of the main driving arm 34 is moved to a lower position of the horizontal piece 14*b* of the stopper 14 and is thus released from the control of the stopper 14 so that the swinging motion can be carried out [see FIG. 2(*a*)].

More specifically, during the execution of the thread cutting operation by the moving knife 5, the pin 34*b* of the main driving arm 34 is inserted into the groove-shaped guide portion 22*a* of the knife driving cam 22 in a state in which the main driving arm 34 is pushed downward and is present below the position of the horizontal piece 14*b* of the stopper 14 [see FIG. 2(*a*)]. In the execution of the thread cutting operation, consequently, the pin 34*b* of the main driving arm 34 can be prevented from being slipping off from the groove-shaped guide portion 22*a* of the knife driving cam 22. More specifically, even if the power supply of the sewing machine is turned OFF during the execution of the thread cutting operation, the pin 34*b* of the main driving arm 34 does not slip off from the groove-shaped guide portion 22*a* of the knife driving cam 22 so that the insertion state is maintained.

By detecting that the main driving arm 34 is moved downward and is positioned in a lower part, the microswitch 27 can detect whether the moving knife 5 is carrying out (executing) or stopping the thread cutting operation. By the structure, when the power supply is suddenly turned OFF during the operation of the sewing machine and is then turned ON again, whether the moving knife 5 is carrying out the thread cutting operation (execution) is recognized by the microswitch 27 to be the thread cutting operation detecting mechanism. Thus, it is possible to give an instruction for a subsequent proper operation.

There is a time lag before the tip of the pin 34*b* is engaged with the groove-shaped guide portion 22*a* of the knife driving cam 22 so that the thread cutting mechanism 52 is actually operated after the main driving arm 34 is pushed downward by the driving link 26 and the microswitch 27 is then turned ON. That is because a predetermined time is required for the engagement of the pin 34*b* depending on the position of the groove-shaped guide portion 22*a* (a phase of the lower shaft 21). By detecting that the tip of the pin 34*b* is engaged with the groove-shaped guide portion 22*a* of the knife driving cam 22 by means of an appropriate sensor, it is possible to judge whether it is a time lag state before the actual operation of the thread cutting mechanism 52 or not. Depending on the judgment, it is also possible to differ the operation.

For example, where the automatic thread cutting mechanism is in the time lag state when the power supply is turned ON and the thread cutting mechanism 52 is not actually operated, it is preferable to return only the thread cutting mechanism driving mechanism 51 into an initial position. By the operation, it is possible to make the mechanism 52 return into the initial state (the non-thread cutting working state) without completing the thread cutting work. When the time lag state is over, it is preferable to complete the thread cutting work and to carry out the return into the non-thread cutting working state.

What is claimed is:

1. A sewing machine having an automatic thread cutting mechanism, the automatic thread cutting mechanism comprising:

state detecting means for detecting whether said mechanism is in a thread cutting working state or in an initial state and non-thread cutting working state; and control means for controlling the automatic thread cutting mechanism to be returned into said initial and non-thread cutting working state position in the case in which the thread cutting mechanism is set in the thread cutting working state when a power supply is turned ON based on the detection of the state which is carried out by the state detecting means, wherein said control means carries out a control to return the thread cutting mechanism into said initial and non-thread cutting working state position after making said mechanism complete the thread cutting work.

2. The sewing machine according to claim 1, wherein the automatic thread cutting mechanism includes: a moving knife to be reciprocated; a fixed knife for cutting a thread together with the moving knife; a main driving arm for reciprocating the moving knife; and a knife driving cam coupled only in thread cutting and driving the main driving arm, wherein the working detecting means detects that the main driving arm and the knife driving cam are coupled to each other, thereby detecting that the automatic thread cutting mechanism is set in the thread cutting working state.

3. A sewing machine having an automatic thread cutting mechanism, the automatic thread cutting mechanism comprising:

state detecting means for detecting whether said mechanism is in a thread cutting working state or in an initial state and non-thread cutting working state; and control means for controlling the automatic thread cutting mechanism to be returned into said initial state and non-thread cutting working state position in the case in which the thread cutting mechanism is set in the thread cutting working state when a power supply is turned ON based on the detection of the state which is carried out by the state detecting means;

wherein a thread cutting work of the thread cutting mechanism has a time lag before the thread cutting mechanism is actually operated after receiving a thread cutting command, the state detecting means can detect whether the thread cutting working state is set in the time lag state or passes the time lag state, and the control means carries out a control to return the automatic thread cutting mechanism into said initial and non-thread cutting working state position without making the mechanism complete the thread cutting work in the case in which the thread cutting mechanism is set in the time lag state when the power supply is turned ON.

4. The sewing machine according to claim 3, wherein the control means further carries out a control to return the automatic thread cutting mechanism into said initial and non-thread cutting working state position after making the mechanism complete the thread cutting work in the case in which the thread cutting mechanism passes the time lag state when the power supply is turned ON.

5. A sewing machine having an automatic thread cutting mechanism for cutting a thread by operating a thread pressing member (7) crossing a portion placed above a path for a bobbin thread which communicates from a bobbin (24) in a horizontal rotating hook to a needle hole (30*a*) of a throat plate (49), and a moving knife disposed along the thread pressing member (7) between the thread pressing member (7) and the needle hole (30*a*) and reciprocated between an initial leftmost point position and an end point in a going direction, thereby cutting a thread, comprising:

state detecting means for detecting a thread cutting working state in which the automatic thread cutting mechanism is placed apart from said initial leftmost point position; and control means for carrying out a control to return the automatic thread cutting mechanism into said initial leftmost point position in the case in which the thread cutting mechanism is set in the thread cutting working state when a power supply is turned ON based on the detection of the state which is carried out by the state detecting means; wherein said control means carries out a control to return the thread cutting mechanism into said initial leftmost point position after making the mechanism complete the thread cutting work.

* * * * *